US005817992A

United States Patent [19]

D'Antonio

[11] Patent Number: 5,817,992

[45] Date of Patent: Oct. 6, 1998

[54] PLANAR BINARY AMPLITUDE DIFFUSOR

[75] Inventor: Peter D'Antonio, Upper Marlboro, Md.

[73] Assignee: RPG Diffusor Systems, Inc., Md.

[21] Appl. No.: 810,770

[22] Filed: Mar. 5, 1997

[51] Int. Cl.[6] ..... E04B 1/82

[52] U.S. Cl. ..... 181/295; 181/30

[58] Field of Search ..... 181/286, 288, 181/292, 293, 294, 295, 30

[56] References Cited

U.S. PATENT DOCUMENTS

| | | | |
|---|---|---|---|
| 2,586,797 | 2/1952 | Fisk et al. | 181/286 |
| 3,276,537 | 10/1966 | Halbostad et al. | 181/286 |
| 4,303,144 | 12/1981 | Wirt | 181/288 |
| 4,529,637 | 7/1985 | Hankel | 181/286 |
| 4,821,839 | 4/1989 | D'Antonio et al. | 181/286 X |
| 4,821,841 | 4/1989 | Woodward et al. | 181/286 |

*Primary Examiner*—Khanh Dang
*Attorney, Agent, or Firm*—H. Jay Spiegel

[57] ABSTRACT

A two-dimensional binary amplitude diffusor (BAD) offering both absorption and modest diffusion is disclosed. The invention consists of a flat-faced panel with a series of alternating reflective and absorptive regions or patches defined by a binary sequence consisting of zeros and ones with a flat power spectrum, such as the Maximum Length Sequence (MLS) based upon shift register theory. Combining regions of absorption and reflection in the manner described herein results in an effective combination of absorption and diffusion.

16 Claims, 11 Drawing Sheets

| | | | | | |
|---|---|---|---|---|---|
| a1 | a7 | a13 | a4 | a10 | |
| a11 | a2 | a8 | a14 | a5 | a11 |
| a6 | a12 | a3 | a9 | a15 | a6 |
| | a7 | a13 | a4 | a10 | |
| | | | | a5 | |
| | | | | | etc. |

FIG. 3

| | | | | |
|---|---|---|---|---|
| 0 | 1 | 1 | 1 | 1 |
| 0 | 0 | 1 | 1 | 0 |
| 0 | 1 | 0 | 0 | 1 |

FIG. 4

| | | | | | | | | |
|---|---|---|---|---|---|---|---|---|
| 0 | 0 | 0 | 1 | 0 | 0 | 1 | 0 | 0 |
| 0 | 0 | 1 | 1 | 1 | 1 | 1 | 1 | 0 |
| 0 | 1 | 0 | 1 | 1 | 1 | 1 | 0 | 1 |
| 0 | 1 | 0 | 0 | 1 | 1 | 0 | 0 | 1 |
| 0 | 1 | 1 | 1 | 0 | 0 | 1 | 1 | 1 |
| 0 | 0 | 1 | 0 | 1 | 1 | 0 | 1 | 0 |
| 0 | 1 | 1 | 0 | 0 | 0 | 0 | 1 | 1 |

FIG. 5

| | | | | | | | | | | | | | | | | |
|---|---|---|---|---|---|---|---|---|---|---|---|---|---|---|---|---|
| 1<br>0 | 121<br>1 | 241<br>0 | 106<br>1 | 226<br>0 | 91<br>1 | 211<br>1 | 76<br>1 | 196<br>0 | 61<br>1 | 181<br>1 | 46<br>1 | 166<br>0 | 31<br>1 | 151<br>0 | 16<br>1 | 136<br>0 |
| 137<br>0 | 2<br>0 | 122<br>1 | 242<br>0 | 107<br>0 | 227<br>0 | 92<br>1 | 212<br>1 | 77<br>0 | 197<br>1 | 62<br>1 | 182<br>0 | 47<br>0 | 167<br>0 | 32<br>1 | 152<br>0 | 17<br>0 |
| 18<br>1 | 138<br>1 | 3<br>1 | 123<br>0 | 243<br>1 | 108<br>0 | 228<br>1 | 93<br>1 | 213<br>0 | 78<br>1 | 198<br>1 | 63<br>0 | 183<br>1 | 48<br>0 | 168<br>1 | 33<br>1 | 153<br>1 |
| 154<br>0 | 19<br>1 | 139<br>1 | 4<br>0 | 124<br>1 | 244<br>1 | 109<br>1 | 229<br>0 | 94<br>0 | 214<br>0 | 79<br>1 | 199<br>1 | 64<br>1 | 184<br>0 | 49<br>1 | 169<br>1 | 34<br>0 |
| 35<br>0 | 155<br>0 | 20<br>1 | 140<br>1 | 5<br>1 | 125<br>0 | 245<br>0 | 110<br>1 | 230<br>0 | 95<br>1 | 215<br>0 | 80<br>0 | 200<br>1 | 65<br>1 | 185<br>1 | 50<br>0 | 170<br>0 |
| 171<br>0 | 36<br>0 | 156<br>0 | 21<br>1 | 141<br>1 | 6<br>0 | 126<br>1 | 246<br>0 | 111<br>0 | 231<br>0 | 96<br>1 | 216<br>0 | 81<br>1 | 201<br>1 | 66<br>0 | 186<br>0 | 51<br>0 |
| 52<br>1 | 172<br>1 | 37<br>1 | 157<br>1 | 22<br>0 | 142<br>0 | 7<br>0 | 127<br>1 | 247<br>0 | 112<br>1 | 232<br>0 | 97<br>0 | 217<br>0 | 82<br>1 | 202<br>1 | 67<br>1 | 187<br>1 |
| 188<br>1 | 53<br>0 | 173<br>0 | 38<br>1 | 158<br>1 | 23<br>1 | 143<br>1 | 8<br>1 | 128<br>0 | 248<br>1 | 113<br>1 | 233<br>1 | 98<br>1 | 218<br>1 | 83<br>0 | 203<br>0 | 68<br>1 |
| 69<br>1 | 189<br>0 | 54<br>1 | 174<br>0 | 39<br>0 | 159<br>1 | 24<br>1 | 144<br>0 | 9<br>0 | 129<br>0 | 249<br>1 | 114<br>1 | 234<br>0 | 99<br>0 | 219<br>1 | 84<br>0 | 204<br>1 |
| 205<br>1 | 70<br>0 | 190<br>1 | 55<br>1 | 175<br>1 | 40<br>1 | 160<br>0 | 25<br>0 | 145<br>0 | 10<br>0 | 130<br>0 | 250<br>1 | 115<br>1 | 235<br>1 | 100<br>1 | 220<br>0 | 85<br>1 |
| 86<br>0 | 206<br>1 | 71<br>0 | 191<br>0 | 56<br>1 | 176<br>1 | 41<br>0 | 161<br>1 | 26<br>0 | 146<br>1 | 11<br>0 | 131<br>1 | 251<br>1 | 116<br>0 | 236<br>0 | 101<br>1 | 221<br>0 |
| 222<br>1 | 87<br>1 | 207<br>0 | 72<br>1 | 192<br>0 | 57<br>0 | 177<br>1 | 42<br>0 | 162<br>0 | 27<br>0 | 147<br>1 | 12<br>0 | 132<br>0 | 252<br>1 | 117<br>0 | 237<br>1 | 102<br>1 |
| 103<br>0 | 223<br>1 | 88<br>1 | 208<br>1 | 73<br>0 | 193<br>1 | 58<br>0 | 178<br>0 | 43<br>0 | 163<br>0 | 28<br>0 | 148<br>1 | 13<br>0 | 133<br>1 | 253<br>1 | 118<br>1 | 238<br>0 |
| 239<br>1 | 104<br>1 | 224<br>0 | 89<br>0 | 209<br>1 | 74<br>0 | 194<br>0 | 59<br>0 | 179<br>0 | 44<br>0 | 164<br>0 | 29<br>0 | 149<br>1 | 14<br>0 | 134<br>0 | 254<br>1 | 119<br>1 |
| 120<br>1 | 240<br>0 | 105<br>0 | 225<br>0 | 90<br>0 | 210<br>1 | 75<br>0 | 195<br>1 | 60<br>0 | 180<br>1 | 45<br>0 | 165<br>1 | 30<br>0 | 150<br>0 | 15<br>0 | 135<br>0 | 255<br>1 |

| | | |

| | | |
|---|---|---|
| 1 | 1 | 1 |
| -1 | 1 | -1 |
| -1 | -1 | 1 |
| -1 | -1 | 1 |
| -1 | 1 | -1 |

PLANAR BINARY AMPLITUDE DIFFUSOR

BACKGROUND OF THE INVENTION

The sound that we hear in a room is a combination of the direct sound and the indirect reflections from the room's boundary surfaces and internal contents. Since these indirect reflections affect the way we perceive the sound source, control of the indirect reflections is a central concern of architectural acoustic room design. The indirect reflections can be controlled by absorption, reflection and/or diffusion. Sound is attenuated by absorption, re-directed by reflection and uniformly dispersed by diffusion. Typically sound absorption is accomplished by porous absorbers, such as open cell foam or fiberglass, low frequency membrane materials or Helmholtz-type resonators. Reflection is accomplished by a room's existing inherently reflective boundary surfaces or reflecting panels and diffusion is accomplished by relief ornamentation or dedicated commercial diffusors based on the number theoretic sequences of reflection phase gratings such as disclosed in Applicant's prior U.S. Pat. Nos. D291,601; 4,964,486; 5,027,920; 5,193,318; and 5,226,267.

In most room designs, the room's geometry is used to provide the reflection pattern, and modal characteristics. Absorption and diffusion are provided as flush mounted, surface mounted or free-standing elements. In general, sufficient broad bandwidth absorption can be accomplished with a device thickness of 1–4", however, broad-bandwidth diffusion can require significant depths (typically a half-wavelength at the design frequency). In many situations, this depth is simply not available. Therefore, it would be advantageous to describe a diffusive surface with a thickness of 1" or greater. It is also useful, in spaces where the depth of surface treatment is limited, to utilize a single surface which provides diffusion and absorption. This is the case in small music rehearsal rooms, conference rooms, and the new 5.1 discrete home theaters. Applicant has previously described an absorption phase grating depth to accomplish this in U.S. Pat. No. 4,821,839, but the disclosed invention requires at least 4" of depth to be effective and its surface topology is not flat. Therefore, it would be advantageous to describe a surface that combines absorptive and diffusive properties but can be made in a device thickness from 1–4".

To develop such a device, it is important to realize that sound waves can be diffused by varying the phase of the scattered waves, as in reflection phase gratings having a complex surface depth topology, or by varying the amplitudes of the scattered waves. Reflection phase gratings are formed by an array of wells of equal width and varied depths. The depth sequence can be determined by number theoretic sequences such as the quadratic residue number theory sequence, primitive root sequence or any sequence having a flat power spectrum. These sequences have been previously described by Applicant in one-dimensional and two-dimensional form in the patents listed above.

SUMMARY OF THE INVENTION

The present invention relates to a planar binary amplitude diffusor.

In this invention what is described is a novel two-dimensional binary amplitude diffusor (BAD). Instead of being formed by an array of wells of equal widths and varied depths as in the reflection phase grating-type diffusor, the inventive panel consists of a flat-faced panel with a series of alternating reflective and absorptive regions or patches. Since Applicant is disclosing reflective and absorptive regions or patches, a binary sequence consisting of zeros and ones is appropriate to describe the surface configuration. Applicant has found that the Maximum Length Sequence based upon shift register theory is an ideal sequence to employ. It has a flat power spectrum and its values are easily computed as described. However, any binary sequence which has a flat power spectrum is a suitable candidate. We can assign the 1 in the sequence to a reflective section and 0 to an absorptive section or vice-versa. Applicant has found that combining regions of absorption and reflection in the manner described herein results in an effective diffusor. The inventive panel may be fabricated with any thickness of 1" or greater. In theory, the reflective regions should have an absorption coefficient of 0 and the absorptive regions should have an absorption coefficient of 1. However, in practice, these criteria can be relaxed, such that the reflective regions can have nominal thickness and the absorptive thickness can be 1" or more.

Accordingly, it is a first object of the present invention to provide a planar binary amplitude diffusor which offers greater diffusion than a random or alternating distribution of reflective and absorptive patches.

It is a further object of the present invention to provide such a device which offers two-dimensional diffusion.

It is a further object of the present invention to provide such a device which offers reflection control without destroying ambiance for more natural sounding rooms.

It is a further object of the present invention to provide such a device which simultaneously provides two-dimensional diffusion and absorption in a single flat-faced acoustical treatment.

It is a further object of the present invention to provide such a device which offers broad bandwidth diffusion with a high frequency cutoff equal to the speed of sound divided by twice the width of the reflective or absorptive element.

It is a further object of the present invention to provide such a device which offers broad bandwidth absorption lying between that of a purely reflective panel and an absorptive panel of the same thickness.

It is a further object of the present invention to provide such a device which offers two-dimensional diffusion and extended low frequency absorption by increasing the thickness of the panel.

It is a still further object of the present invention to provide such a device that may be made in an extremely thin configuration, preferably within the range of 1–4".

It is a yet further object of the present invention to provide such a device that may be covered with an aesthetically pleasing fabric.

These and other objects, aspects and features of the present invention will be better understood from the following detailed description of the preferred embodiment when read in conjunction with the appended drawing figures.

BRIEF DESCRIPTION OF THE DRAWINGS

FIG. 3 shows a two-dimensional MLS array where m equals 4.

FIG. 4 shows a two-dimensional MLS array where m equals 6.

FIG. 5 shows a two-dimensional MLS array for m equals 8.

FIG. 6 shows a two-dimensional MLS array for m equals 10.

SPECIFIC DESCRIPTION OF THE PREFERRED EMBODIMENT

Figures 1, 2:
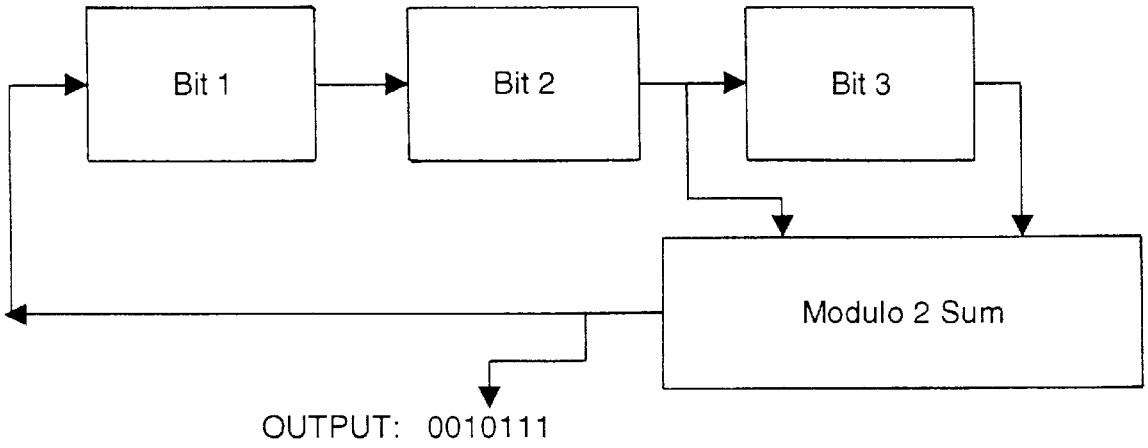
FIG. 1 shows a schematic representation of a shift register sequence generator used to create a one-dimensional maximum length sequence (MLS).
FIG. 2 shows a schematic representation of the procedure employed to form a two-dimensional maximum length sequence (MLS) array from a one-dimensional sequence.

FIG. 1 illustrates the m=3 shift register stages (bits 1, 2 and 3) and taps into the modulo 2 summation register needed to generate a $2^m-1$ element Maximum Length Sequence (MLS). Initially all bits are set to 1 to start the sequence. Arrows indicate the bit flow and the output tap is indicated with the MLS sequence for m=3. MLS sequences are, by definition, the longest codes that can be generated by a given shift register sequence generator. A shift register sequence generator consists of a shift register working in conjunction with appropriate logic, which feeds back a logical combination of the state of two or more of its stages to its input. The output of a sequence generator, and the contents of its m stages at any sample (clock) time, is a function of the outputs of the stages fed back at the preceding sample time. Feedback connections have been tabulated for MLS codes from 3 to 100 stages.

EXAMPLE

MLS sequences consist of a series of the numbers 0 and 1. They contain $2^m-1$ elements, where m=0,1,2,3 . . . . For m=3 we have 7 elements. For m=4 we have 15 elements and for m=5 we have 31 elements, etc.

Two-dimensional Binary Amplitude Diffusor (BAD) panels can be constructed from the following methodology: Determine a value of m which gives a desired sequence length of $2^m-1$ elements. Determine if $2^m-1$ can be factored into two relative-prime factors, i.e., factors that are not multiples of one another. Factor the one-dimensional (1D) sequence into its two relative primes. For example, m=4 yields 15 elements for which the relative co-primes are 3 and 5. Fill a 3×5 array (FIG. 3) with the 1D sequence starting along the main diagonal and jumping across the array whenever an array boundary is encountered. This is accomplished because the sequence is periodic and we can take advantage of the translational periodicity of the array. Thus, for a sequence a1 . . . a15, the corresponding two dimensional array is shown in FIG. 2.

As shown, the main diagonal of the array with a bold perimeter in FIG. 2 is first filled with array elements a1 through a3. The fourth array element, a4, lies outside the 3×5 array (bold), so it is translated to the fourth element of the first row and the diagonalization continued with element a5 until the right boundary of the array is encountered. Element a6 is then translated to the first element of the third row, with which it is equivalent. Array element a7 falls outside the 3×5 array so it is translated to the second element of the first row, which it is equivalent to. Diagonalization continues with elements a8 and a9. Element a10 falls outside the 3×5 array so it is translated to the fifth element of the first row, which it is equivalent with. Array element "all" falls outside the 3×5 array so it is translated to the first element of the second row, which it is equivalent with, and diagonal element a12 is added. Element a13 falls outside the array and it is translated to the third element of the first row, which it is equivalent to and diagonalization continues up to element a15.

As an example, the maximum length sequence for m=4 (000100110101111) produces the 2D sequence in FIG. 3.

It should be seen that the array blocks cannot attain a square aspect ratio and are always rectangular. To achieve a relatively square aspect ratio and to achieve the required high frequency cutoff, we can select an m=6 (FIG. 4), m=8 (FIG. 5) or m=10 (FIG. 6) sequence. The cutoff frequency is related to that frequency whose wavelength is equal to twice the width of the 2D element (c/2w), where c is the speed of sound (13560 in/sec) and w is the width of the 2D element. Thus for a 23⅝×23⅝ panel we can use a 15×17 (m=8) 255 element array, with 1.575×1.3897 (roughly 4 kHz cutoff) or 31×33 (m=10) 1023 element array, with 0.762×0.716 cells (9 kHz cutoff) could be selected. For a 47¼×47¼ panel we could select a 4095 array with 63×65 elements (with 9 kHz cutoff).

Figure 7:
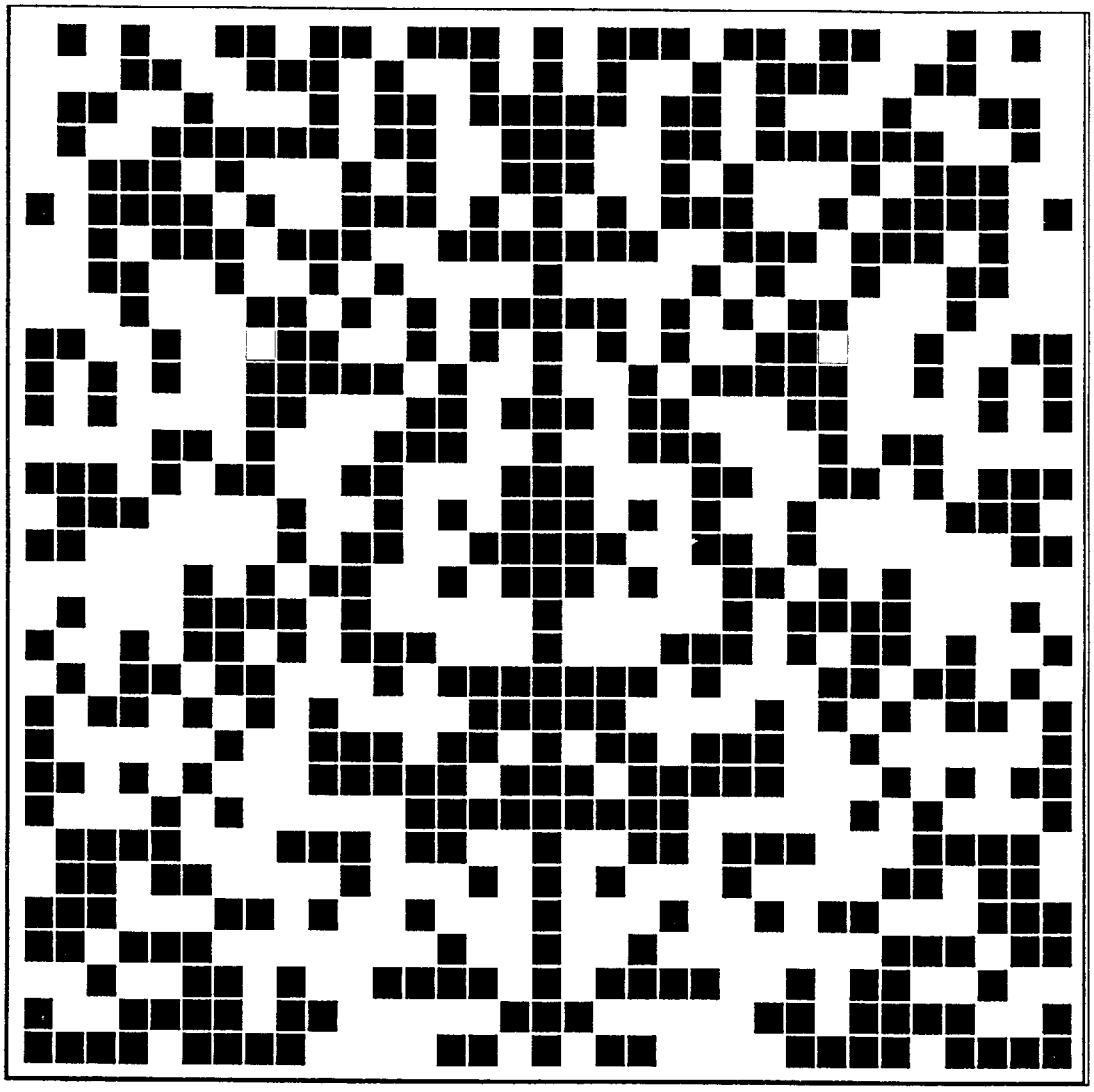
FIG. 7 shows a normal binary amplitude diffusor (BAD) panel.
Figure 8:
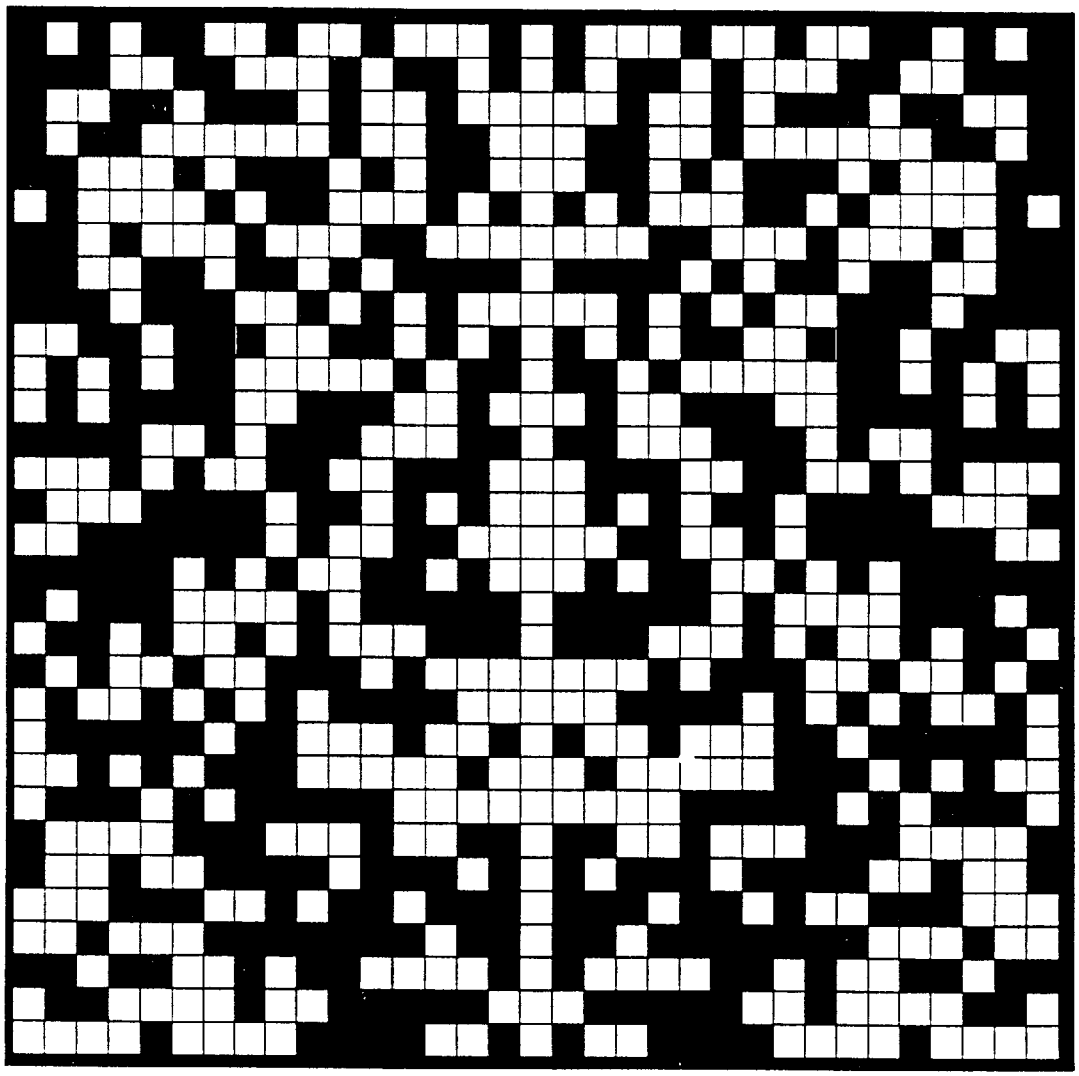
FIG. 8 shows a panel generally corresponding to that of FIG. 7 but inverted.

An example of the 255 array is shown in FIG. 5. The upper numeral of each cell is the well number 1–255 and the lower numeral of each cell is the MLS binary bit (0 for absorption or 1 for reflection). To achieve an upper frequency limit of 9 kHz for a 23⅝×23⅝ panel, a 1023 array, FIG. 6, and cell size of 0.762×0.716 is necessary. The 1023 elements and co-primes 31 and 33 with a rectangular aspect ration of 33/31=1.0645 were selected to form a substantially square array which is necessary for ceiling grids and modular wall panels. We have the liberty to attach a zero or one to either the absorptive or reflective patches, since the magnitude of the frequency response is identical. Therefore, we can describe two panels, a normal panel as shown in FIG. 7, and an inverted panel as shown in FIG. 8. These can be used later in the discussion to minimize lobing which occurs when any scattering element is arranged in a one or two dimensional periodic array.

From the above description of the method for generating Maximum Length Sequences (MLS), and the examples thereof described herein and illustrated in FIGS. 3, 4, 5 and 6, one skilled in the art can generate an MLS of any desired length and which can be factored into two relative-prime factors.

Figure 9:
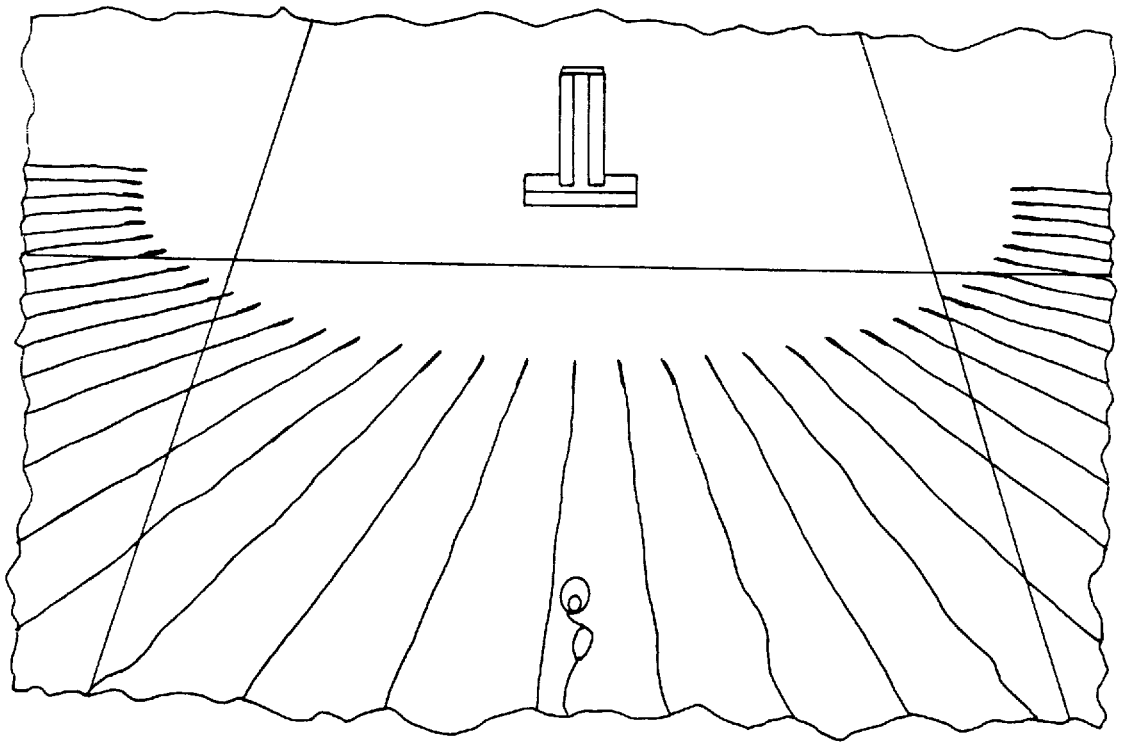
FIG. 9 shows measurement geometry used to employ the "DISC" technique.
Figure 10:
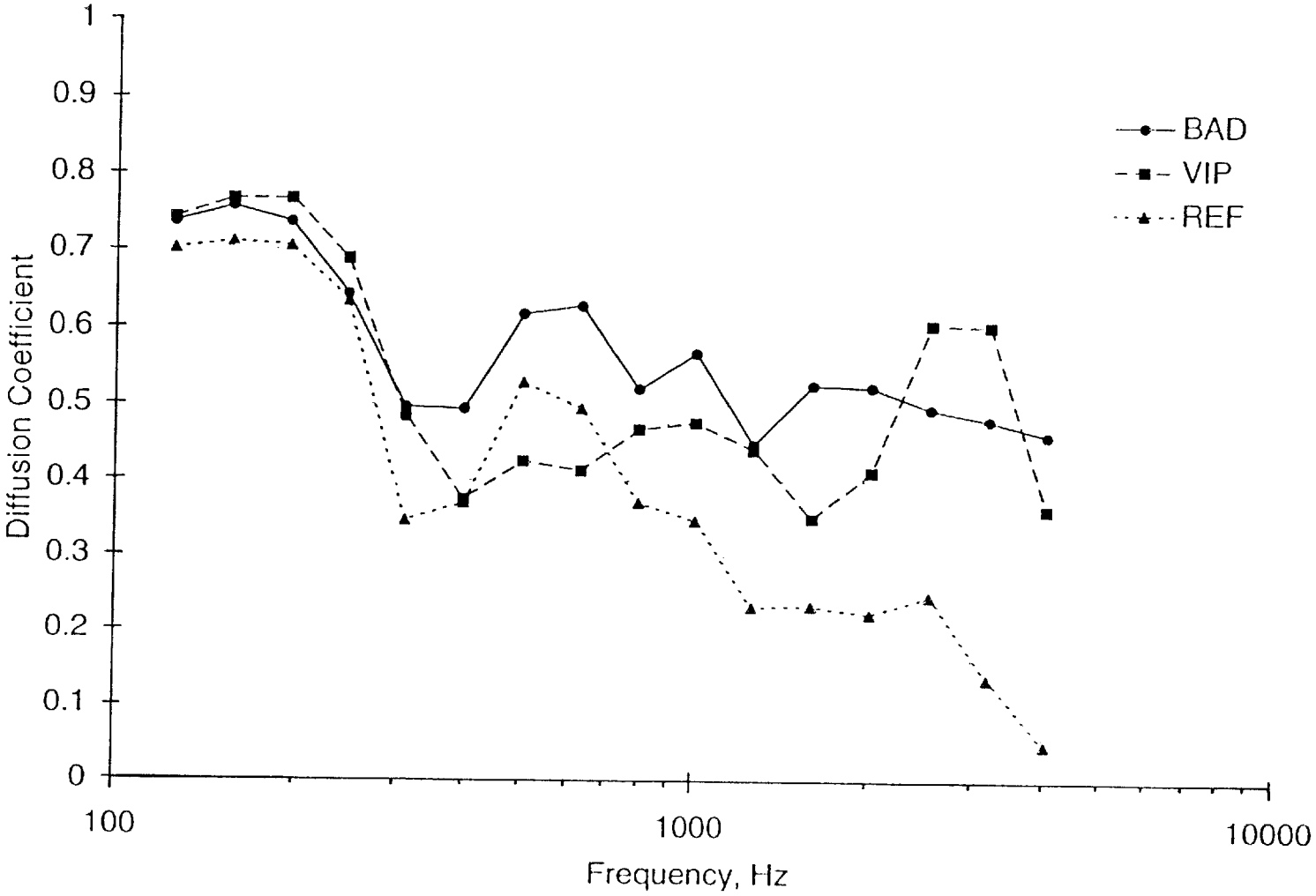
FIG. 10 shows a graph of the diffusion coefficient for a panel in accordance with the teachings of the present invention compared with that of a flat reflective surface (REF) and a non-number-theoretic regular variable impedance array (VIP).
Figure 11:
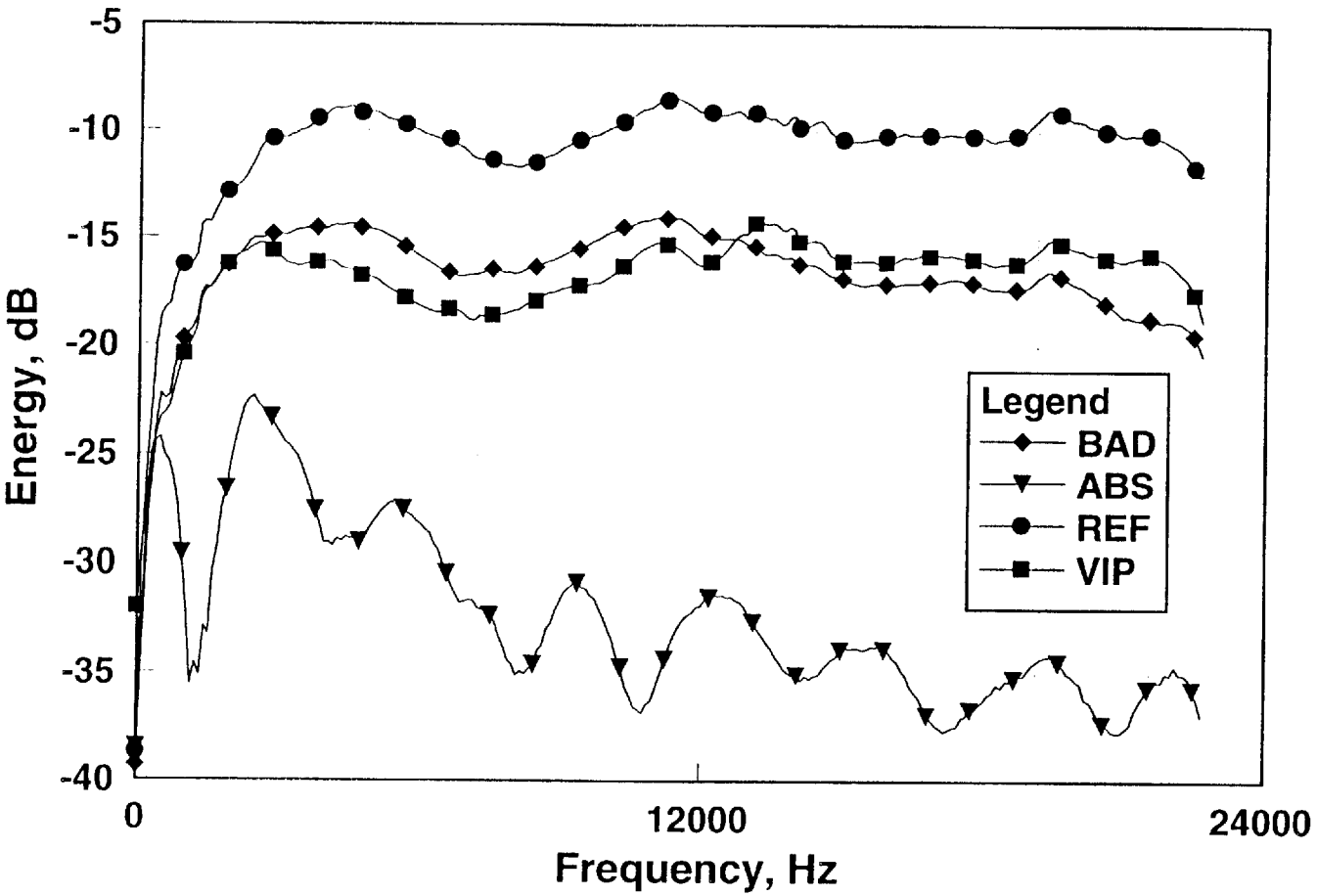
FIG. 11 shows frequency responses for a binary amplitude diffusor (BAD), a variable impedance array (VIP), a reflective panel (REF), and an absorptive panel (ABS) of comparable size.

Applicant has performed experimentation concerning BAD panel design. To determine the diffusion response of the inventive BAD panel, Applicant has utilized the DISC measuring technique. As shown in FIG. 9, the technique consists of a 37 microphone semicircle and additionally, computerized stimulus and response system (not shown). Under the direction of the measurement computer (not shown), a maximum length stimulus is emitted and detected by each microphone in turn. After 37 identical stimuli are emitted and stored, the data are processed to determine the impulse response at all scattering angles in 5 degree increments about the semicircle for a given angle of incidence. These data are transformed into a graph of frequency response versus scattering angle. Polar responses are determined at ⅓-octave frequency centers. To determine the diffusion response, the standard deviation of the ⅓-octave polar responses is determined and plotted versus frequency. The data in this curve are normalized by the theoretical standard deviation of an infinite reflector and subtracted from the number one. The diffusion response for a $5^{th}$ scale panel based on m=4, measuring 7.5 wide with 0.5 elements, is illustrated in FIG. 10. At full scale this amounts to a diffusion bandwidth between 363 Hz to 2712 Hz. It can be seen in FIG. 10 that the BAD panel is better in performance than the Variable Impedance Array (VIP) and reflective panel (REF) over this range. In FIG. 11, the frequency responses are compared and a completely absorptive panel (ABS) is included for comparison. Thus, it is demonstrated that the BAD panel both absorbs and diffuses. The sound that is not absorbed is diffused uniformly. The BAD panel falls between the limits of a reflective (REF) and absorptive panel (ABS) as demonstrated in FIG. 11.

To fabricate a BAD panel, Applicant must generate an array of reflective and absorptive rectangular patches as described hereinabove. There are numerous ways to fabricate such a panel, but three preferred approaches are as follows:

APPROACH 1

RESIN HARDENING

Using a negative mask, one can spray a water based resin over the surface of a porous material such as fiberglass or open cell foam. The panel would be upholstered with an open weave fabric to provide a decorative appearance.

APPROACH 2

APPLICATION OF RESORPTIVE MASK

One can apply a positive mask, consisting of reflective areas and open areas based on the MLS theory, to the surface of a porous absorber. The open areas in the mask expose the absorptive material below. A pressure sensitive adhesive can be used to bond the mask to the porous panel. This mask can be cut from a plastic or metal film using several techniques including die cutting or CNC routing. The CNC approach is quite versatile and can easily be adapted to different patterns by simply changing a software program.

APPROACH 3

COMPRESSION MOLDING

The absorptive/reflective pattern can be formed by compression molding a pre-impregnated uncured low density fiberglass matte. A "male" tool with the reflective pattern is used to compress the matte forming areas of high density. Under pressure and temperature, the impregnated resin cures to form the intended matrix of low and high density fiberglass patches.

IMPLEMENTATION OF THE BINARY ABSORPTION DIFFUSOR (BAD)

The invention may be applied to, but is not limited to, several classes of BAD products:

A. FLAT PANELS

The BAD panels may be constructed of a series of reflective and absorptive rectangular patches. To economically manufacture such panels, any of the three approaches previously mentioned can be used.

B. FLAT PANELS WITH REAR BASS ABSORBING MEMBRANE

The BAD panel, however manufactured, can be attached to the face of a diaphragmatic membrane absorber to simultaneously provide mid-high frequency absorption and diffusion to complement the low frequency absorption of the membrane.

C. VARIABLE ACOUSTIC "TRIFFUSOR"

Applicant describes a triangular column with a reflective side, an absorptive and a "BAD" side. Thus, one panel can offer all of the acoustical control possible. These columns rotate about their vertical axis on a bearing or lazy-Suzan bearing. Several such columns are contiguously mounted along a wall or flush mounted into a wall. The array is such that all panels can be rotated so the same acoustical surface faces the room or panels can be oriented with different surfaces selected, as desired.

D. VARIABLE ACOUSTIC BIFFUSOR

This is essentially a two-sided version of the TRIFFUSOR in which either an absorptive or "BAD" surface can face the room. These panels typically can be applied with hook and loop fastener or placed between two fixed horizontal tracks allowing the panels to be removed and rotated.

E. HANGING BAFFLES

The BAD surface can be applied to one or two sides of a hanging baffle to offer a combination of absorption and diffusion.

PREFERRED APPLICATIONS

1. HOME THEATER

New home theater "5.1" discrete digital formats offer the ability to provide 5 separate digital outputs for the left, center, right, left surround, right surround and low frequency effects sub woofer, for an unparalleled realistic listening experience. In many residential settings it is not always possible to provide the appropriate acoustical treatment due to aesthetic reasons. Thus in many cases upholstered absorptive panels are used with compromised results. The "BAD" panel can be upholstered in an attractive range of fabrics and thus can be used anywhere traditional fabric upholstered absorptive panels are used. The "BAD" surfaces provide the proper amount of attenuation and ambiance to provide reflection control without removing all of the room's ambiance. The depth of the absorptive panel backing can be adjusted to control the reverberation time or decay time in the room. The binary sequence can be adjusted to suit the width of the reflective/absorptive elements to control the high frequency limit of the BAD panels.

Figure 12:
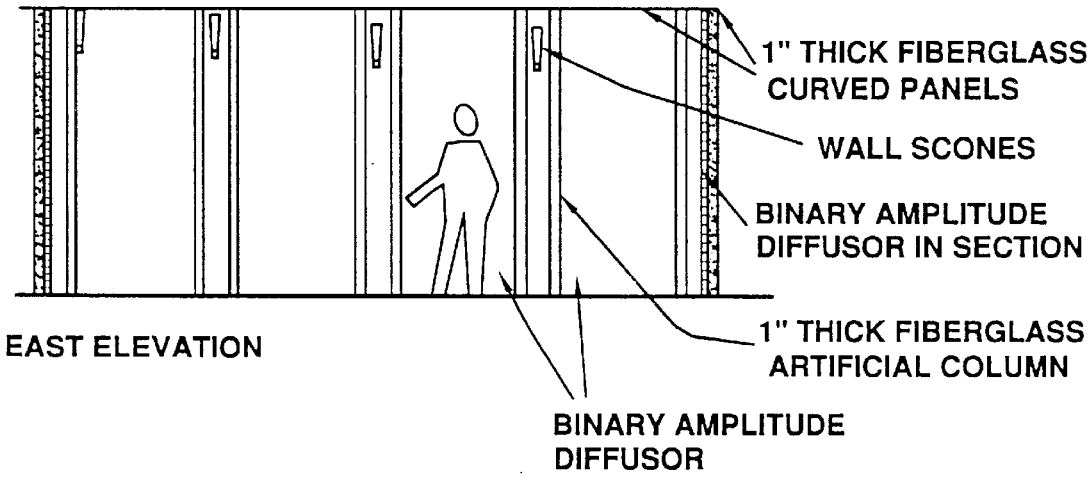
FIGS. 12 and 13 show two opposed side views of a home theater application employing the inventive binary amplitude diffusor (BAD).
Figure 13:
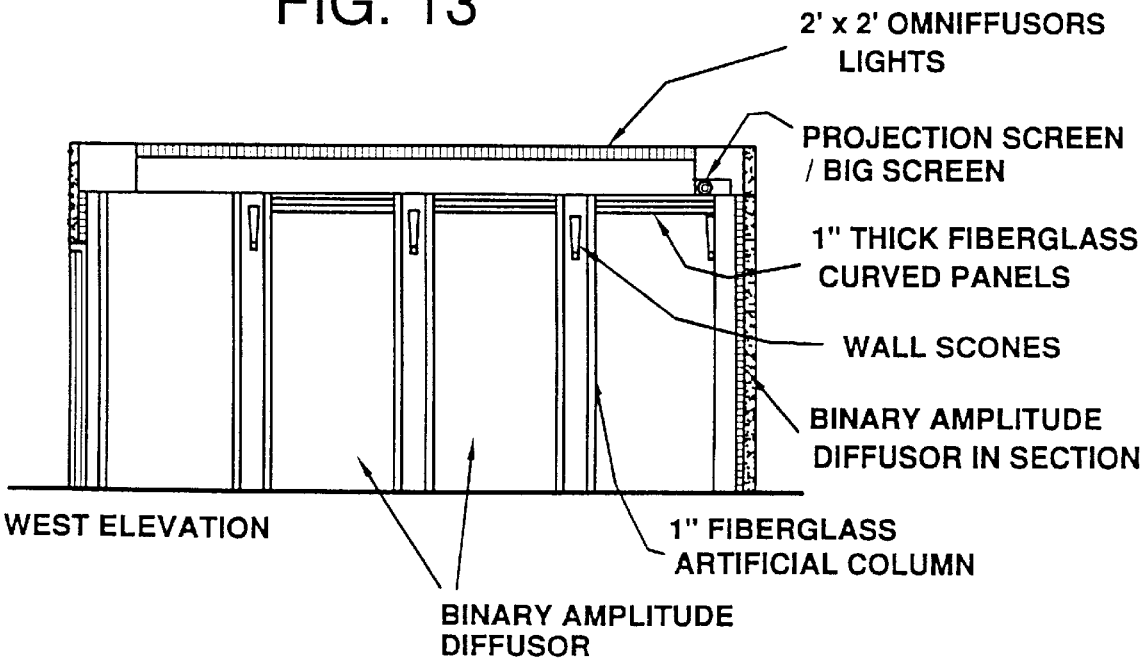

FIGS. 12 and 13 show a typical home theater application of BAD panels on walls and ceiling.

2. MUSIC REHEARSAL ROOMS

Reflection control in individual practice rooms and larger band rooms has traditionally been accomplished with fabric upholstered panels. This often creates a dead space in which it is difficult to perform musically. The "BAD" panel provides an excellent balance between absorption and diffusion to provide a musically ambient space for musical practice or performance.

3. CONFERENCE ROOMS

Reflection control in conference rooms has traditionally been accomplished by total or partial coverage using fabric upholstered absorptive panels. This compromise either makes the room too dead for conversation or teleconferencing or contains reflective hot spots that introduce interfering reflections and decrease gain before feedback in teleconferencing applications.

4. CLASSROOMS

Intelligibility of the spoken word is essential in a classroom. Unfortunately, too often, classrooms are either too reverberant or too dead. The BAD panel allows complete coverage of all wall surfaces without making the room too dead. In this way reflections are controlled and a natural ambiance is maintained.

5. RECORDING AND BROADCAST STUDIOS

When the construction budget does not allow for proper acoustical treatment, recording and broadcast studios often resort to fabric wrapped or foam absorptive panels. This often results in a space that is too acoustically "dead" to be useful. The "BAD" panels make reflection control using "abffusion" easy and possible with a reduced application depth and cost effectiveness.

6. AUDITORIUMS

Fabric wrapped absorptive panels are traditionally used when the budget does not allow for more acoustically appropriate treatments. Often because of the large surface areas in these facilities, absorptive panels are used in 50% of the wall surface area by alternating absorptive panels with untreated reflective wall areas. This often leads to strong specular reflections from the untreated areas. Also, if the budget did allow for complete absorptive treatment, the room would be too dead for musical utilization. Thus, the BAD panel is appropriate in providing full coverage with the appropriate mix of absorption and diffusion in the same panel for uniformly enhanced acoustical results.

7. LARGE AREA APPLICATIONS

Figures 14, 15:
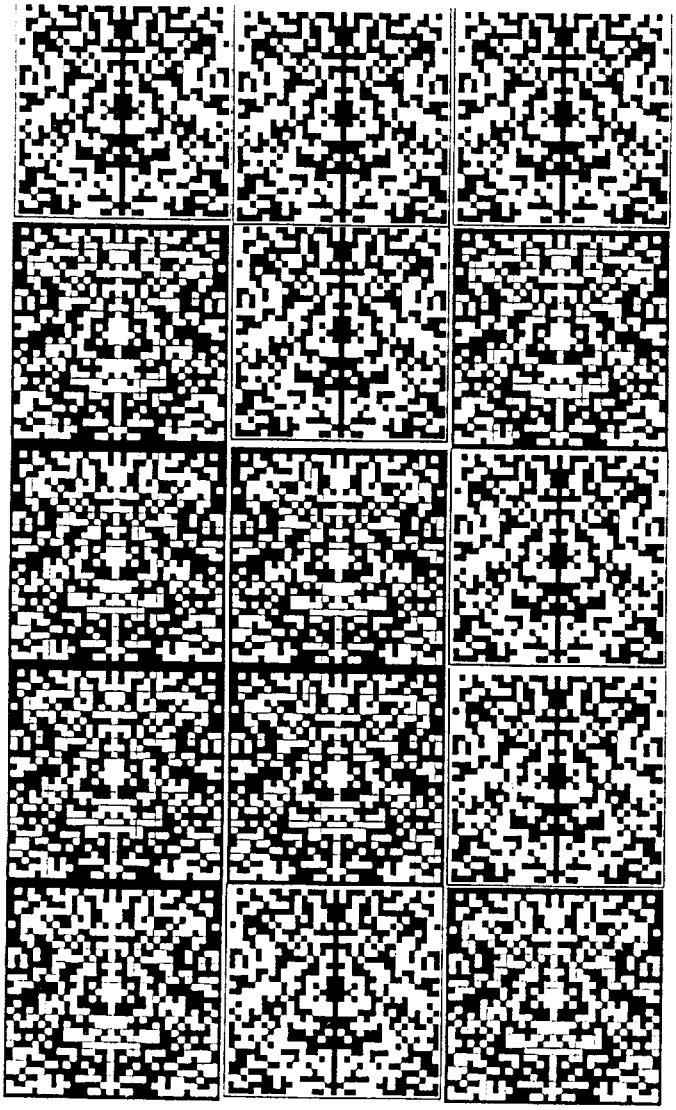
FIG. 14 shows a schematic representation of a modulated panel array in accordance with the teachings of the present invention.
FIG. 15 shows a modulated panel array in accordance with the teachings of the present invention.

When a given surface topology is repeated periodically, "lobing" is created due to the constructive and destructive interference effects that are setup by the incident and scattered sound. This lobing causes the sound to be scattered into preferred diffraction directions and minimizes the effectiveness of the diffusion. These diffraction directions are determined by the size of the repeat unit and the intensity in the scattered directions is determined by the shape of the scattering repeat unit. In addition, as the number of repeat units increases, the sound is progressively scattered into narrower and narrower lobes, limited to only the diffraction directions. To overcome this limitation, Applicant can multiplicatively modulate the topology of a "BAD" panel, using a second binary sequence, to form an array of normal and inverted BAD panels. The m=4 MLS sequence is shown in FIG. 14. An example of a modulated BAD array for m=10 is shown in FIG. 15.

Accordingly, an invention has been disclosed in terms of a preferred embodiment thereof, that fulfills each and every one of the objects of the invention as set forth hereinabove and provides a new and useful planar binary amplitude diffusor of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An acoustical device, comprising:

a) a generally rectangular body having a length, a width and a depth;

b) said body having a flat generally rectangular forward facing acoustical surface substantially defined by said length and width;

c) said acoustical surface having a plurality of discrete reflective regions and a plurality of discrete absorptive regions arranged in a pattern, said regions being arranged in accordance with calculation of a binary sequence having a flat power spectrum.

2. The invention of claim 1, wherein said depth is 1" or greater.

3. The invention of claim 1, wherein said generally rectangular body is square.

4. The invention of claim 3, wherein said regions are generally rectangular.

5. The invention of claim 1, wherein said regions are arranged in accordance with calculation of a binary sequence comprising a Maximum Length Sequence (MLS) of the numbers 0 and 1, length of said MLS being defined by a formula $2^m-1$ where m is an integer, and where the number 0 corresponds to one of a reflective region or an absorptive region and where the number 1 corresponds to the other of a reflective region or an absorptive region.

6. The invention of claim 5, wherein said pattern comprises an array comprising a plurality of said regions, said array having numbers of rows and columns defining a number of regions corresponding to said length of said MLS.

7. The invention of claim 6, wherein said array has an unequal number of rows and columns.

8. The invention of claim 1, wherein said absorptive regions include a porous material having micro-pores or interstices that absorb sound.

9. The invention of claim 6, wherein said array includes numbers of rows and columns that are relative co-primes such as, for example, 15×17 or 31×33.

10. The invention of claim 6, wherein said array includes 15 rows and 17 columns.

11. A method of making an acoustical device, including the steps of:

a) providing a generally rectangular body having a length, a width and a depth;

b) providing said body with a flat generally rectangular forward facing acoustical surface;

c) arranging, on said surface, a pattern consisting of a plurality of discrete reflective regions and a plurality of discrete absorptive regions arranged in accordance with calculation of a binary sequence having a flat power spectrum.

12. The method of claim 11, wherein said arranging step includes the steps of:

a) calculating a binary sequence comprising a Maximum Length Sequence (MLS) of the numbers 0 and 1, length of said MLS being defined by a formula $2^m-1$ where m is an integer, which MLS can be factored into relative primes;

b) corresponding the number 0 with one of a reflective region or an absorptive region;

c) corresponding the number 1 with the other of a reflective region or an absorptive region.

13. The method of claim 11, wherein said second-mentioned providing step includes the step of providing said flat forward facing acoustical surface as a rectangle.

14. The method of claim 11, wherein said arranging step includes the step of arranging said pattern in an array comprising a number of rows of regions and a different number of columns of regions.

15. The method of claim 14, wherein said arranging step further includes the step of making each region generally rectangular.

16. The method of claim 12, wherein said step of arranging said pattern includes the step of locating a first number at one corner of said array and locating sequential numbers from said Maximum Length Sequence diagonally across said array.

* * * * *